US011213821B2

(12) United States Patent
Lim et al.

(10) Patent No.: US 11,213,821 B2
(45) Date of Patent: Jan. 4, 2022

(54) MICROFLUIDIC DEVICE AND MANUFACTURING METHOD THEREFOR

(71) Applicant: KOREA UNIVERSITY RESEARCH AND BUSINESS FOUNDATION, Seoul (KR)

(72) Inventors: Chae Seung Lim, Gyeonggi-do (KR); Jeong Hun Nam, Seoul (KR)

(73) Assignee: KOREA UNIVERSITY RESEARCH AND BUSINESS FOUNDATION, Seoul (KR)

( * ) Notice: Subject to any disclaimer, the term of this patent is extended or adjusted under 35 U.S.C. 154(b) by 233 days.

(21) Appl. No.: 16/323,163

(22) PCT Filed: Apr. 10, 2017

(86) PCT No.: PCT/KR2017/003865
§ 371 (c)(1),
(2) Date: Feb. 4, 2019

(87) PCT Pub. No.: WO2018/030609
PCT Pub. Date: Feb. 15, 2018

(65) Prior Publication Data

US 2019/0184396 A1 Jun. 20, 2019

(30) Foreign Application Priority Data

Aug. 12, 2016 (KR) ..... 10-2016-0102883
Sep. 9, 2016 (KR) ..... 10-2016-0116705

(51) Int. Cl.
*B01L 3/00* (2006.01)

(52) U.S. Cl.
CPC ... *B01L 3/502715* (2013.01); *B01L 3/502707* (2013.01); *B01L 3/502761* (2013.01);
(Continued)

(58) Field of Classification Search
CPC ..... B01L 3/502715; B01L 3/502707; B01L 3/502761; B01L 2200/0652;
(Continued)

(56) References Cited

U.S. PATENT DOCUMENTS

2010/0139377 A1 6/2010 Huang et al.
2010/0200092 A1* 8/2010 Beltram ..... B82Y 30/00 137/828

(Continued)

FOREIGN PATENT DOCUMENTS

KR 10-2008-0052296 A 6/2008
KR 10-0862379 B1 10/2008

(Continued)

OTHER PUBLICATIONS

Al, Ye et al. "Separation of *Escherichia coli* Bacteria from Peripheral Blood Mononuclear Cells Using Standing Surface Acoustic Waves", Anal Chem, vol. 85(19), 2013, 9126-9134.

(Continued)

*Primary Examiner* — Jennifer Wecker
*Assistant Examiner* — Michael Paul Shimek
(74) *Attorney, Agent, or Firm* — Casimir Jones, S.C.; Brian F. Bradley

(57) ABSTRACT

The present invention relates to a microfluidic device and a manufacturing method therefore and, more particularly, to a microfluidic device comprising: a first substrate layer; a second substrate layer formed on at least one surface of the first substrate layer; and a plurality of transducers formed on the surface of the first substrate layer and embedded in the second substrate layer, wherein the transducer comprises a conductive microfluidic channel. The present invention can provide an elastic wave substrate microfluidic device capable of controlling an elastic wave according to a property of a microparticle and capable of being manufactured (Continued)

without expensive equipment and complicated process procedures.

14 Claims, 11 Drawing Sheets

(52) U.S. Cl.
CPC ... *B01L 2200/0652* (2013.01); *B01L 2200/12* (2013.01); *B01L 2300/12* (2013.01); *B01L 2400/0436* (2013.01)

(58) Field of Classification Search
CPC ..... B01L 2200/12; B01L 2300/12; B01L 2400/0436; B01L 3/502753; B01L 2400/0493; B01L 2200/10
See application file for complete search history.

(56) References Cited

U.S. PATENT DOCUMENTS

| | | | | |
|---|---|---|---|---|
| 2013/0192958 | A1 | 8/2013 | Ding et al. | |
| 2014/0033808 | A1 | 2/2014 | Ding et al. | |
| 2014/0238153 | A1* | 8/2014 | Wood | G06F 3/011 73/862.627 |
| 2015/0330887 | A1 | 11/2015 | Shin et al. | |
| 2016/0234931 | A1* | 8/2016 | Majidi | H05K 3/107 |

FOREIGN PATENT DOCUMENTS

| | | | |
|---|---|---|---|
| KR | 10-1183436 | B1 | 9/2012 |
| KR | 10-1356933 | B1 | 1/2014 |
| WO | 2008/069551 | | 6/2008 |

OTHER PUBLICATIONS

Tung, Yi-Chung "Pressure sensors and electrical circuits made with liquids", SPIE, 2012, 3 pages.
International Search Report, International Patent Application No. PCT/KR2017/003865, dated Aug. 18, 2017, 2 pages.
EP Search Report, EP Patent Application No. 17839627.1, dated Jan. 24, 2020, 8 pages.

* cited by examiner

Irregularly floating 10 μm fluorescent particles

10 μm fluorescent particles linearly patterned by SSAW

MICROFLUIDIC DEVICE AND MANUFACTURING METHOD THEREFOR

TECHNICAL FIELD

Example embodiments relate to a microfluidic device and a method of manufacturing the microfluidic device.

RELATED ART

Technology for controlling biological microparticles having various attributes in a lab-on-a-chip system based on a microfluidic device is very important in the field of biological research and clinical applications. For example, technology for selectively separating target particles or concentrating sparsely existing target particles with respect to diseased cells or various viruses present in a biological fluid such as blood, urine, and saliva may enhance the sensitivity or accuracy of analysis results.

Currently, research on microdroplet and particle control technology using surface acoustic waves is gaining great attention. This technology may be easily integrated with other technologies and easily designed, and may further use other physical characteristics of microparticles. With the design of a device that may be simply implemented, the technology may control microfluidics or particles or may locally control heat under condition that is harmless to biological particles. Accordingly, the technology has been used to develop sample pretreatment technology that requires mixing, separation, and concentration in clinical diagnostic or biological studies.

To generate a surface acoustic wave, a piezoelectrical material that allows mutual conversion of electro-mechanical energy is used. Accordingly, once electrical energy is applied to the piezoelectric material, the piezoelectrical material may mechanically shrink or expand. Conversely, when the piezoelectrical material shrinks or expands, the electrical energy is generated. Through a standard semiconductor etching process, electrodes appearing as if fingers are crossed as electro-mechanical energy converters may be patterned using a desired shape, dimension, or interval on a piezoelectric substrate. When a frequency corresponding to an interval between the electrodes and an alternating current (AC) voltage are applied to the electrodes, a surface acoustic wave that travels the surface of the piezoelectrical material may be generated on a region in which the electrodes intersect.

A surface acoustic wave-based microfluidic device having a microfluidic channel or chamber is implemented by bonding a channel for flowing or filling floating particles and a piezoelectric substrate on which microelectrodes are patterned to generate and control a surface acoustic wave.

In the related art, it is difficult to precisely align an electrode for forming a transducer on a control target fluid region. That is, a process of patterning the electrode for forming the transducer on a substrate and a process of patterning the control target fluid region are independently performed. Here, since both patterning processes are not performed through the same process, it is difficult to precisely align an electrode pattern and a control target fluid region pattern (control target channel pattern).

Once oxygen plasma is treated to precisely align and bond a microelectrode and a channel during a process of bonding a piezoelectric substrate on which a microelectrode pattern is completed and a microfluidic channel, ethanol is then sprayed to delay a chemical bonding process for precise alignment, and a bonding process using a high magnification microscope is performed. During this process, expert proficiency is required and an additional sample is required for precise bonding. That is, to apply the surface acoustic wave in the microfluid channel, a precise bonding process is required based on a parallelism or designed angle. Further, the skill of a person who carries out the bonding process and separate equipment for the bonding process are required and it is difficult to carry out the precise bonding process according to a decrease in a size of a channel or an electrode and an increase in a region to be aligned in parallel.

If an electrode of generating a surface acoustic wave, a travel distance (displacement) of a particle to be controlled, a path of the particle to be controlled, and an angle of the path are not precisely aligned based on a design, it is difficult to perform a desired target, for example, detection and diagnosis of a desired biotarget material. Also, although a desired performance is not acquired due to a difficulty in adjusting and reprocessing the generated electrode, an electrode pattern may not be adjusted.

A process of manufacturing a piezoelectric substrate on which microelectrodes are patterned requires an additional complex process, such as a wet and dry etching, and expensive equipment, for a process of depositing a metal to be used as an electrode and a patterning process. During the process, environmental pollutants or toxic chemical reagents are required.

DETAILED DESCRIPTION

Technical Subject

At least one example embodiment provides a microfluidic device that may be manufactured to have a relatively high reliability (parallelism and angle) with a simple process and inexpensive cost, instead of using expensive equipment or complex process procedures, and may adjust an acoustic wave based on a property of a control target.

At least one example embodiment also provides a method of manufacturing a microfluidic device.

Subjects to be solved herein are not limited to the aforementioned subjects and other subjects not described herein may be understood by those skilled in the art from the following description.

Technical Solution

According to an aspect of at least one example embodiment, there is provided a microfluidic device including a first substrate layer; a second substrate layer formed on at least one surface of the first substrate layer; and a plurality of transducers formed on the first substrate layer and included in the second substrate layer. The transducer includes a conductive microfluidic channel.

The conductive microfluidic channel may include an electrically conducting channel layer, and the electrically conducting channel layer may include a conductive material that occupies a portion of or all of the conductive microfluidic channel.

The electrically conducting channel layer may include a liquid conductive material; or a solution that contains a conductive material, suspension, or paste.

The conductive material may include a conductive oxide including at least one selected from metal particles of Ag, Pt, Au, Mg, Al, Zn, Fe, Cu, Ni, and Pd; inorganic and polymer electrolytes; a conductive oxide including at least one of indium (In), tin (Sn), zinc (Zn), gallium (Ga), cerium (Ce), cadmium (Cd), magnesium (Mg), beryllium (Be), silver (Ag), molybdenum (Mo), vanadium (V), cupper (Cu), iridium (Ir), rhodium (Rh), ruthenium (Ru), tungsten (W), cobalt (Co), nickel (Ni), manganese (Mn), aluminum (Al), and lanthanum (La), or alloy thereof; and carbon materials of carbon nano tube, carbon powder, graphene, and graphite.

The microfluidic device may further include a control target channel formed on the first substrate layer and included in the second substrate layer. The control target channel may include a microfluidic channel through which a control target fluid flows.

The first substrate may be a flexible substrate that includes a piezoelectric coating layer or a piezoelectric substrate, and the piezoelectric substrate and the piezoelectric coating layer may include at least one of selected from the group consisting of $\alpha$-$AlPO_4$ (berinite), $\alpha$-$SiO_2$ (quartz), $LiTaO_3$, $LiNbO_3$, $SrxBayNb_2O_8$, $Pb_5$—$Ge_3O_{11}$, $Tb_2(MoO_4)_3$, $Li_2B_4O_7$, $Bi_{12}SiO_20$, $Bi_{12}GeO_2$, PZT (lead zirconate titanate), barium titanate (BTO), bismuth ferric oxide (BFO), platinum oxide (PTO), ZnO, CdS, GaN, AlN, VDF, ZnMgO, InN, GeTe, $ZnSnO_3$, $KNbO_3$, $NaNBO_3$, P(VDF-TrFe), P(VDFTeFE), TGS, PZT-PVDF, PZT-silicone rubber, PZT-epoxy, PZT-foam polymer, PZT-foamed urethane, and polyvinylidene difluoride (PVDF).

The second substrate layer may include photocurable polymer, thermosetting polymer, or both thereof, and the second substrate layer may be a transparent polymer substrate.

The microfluidic device may further include a voltage input terminal configured to input an alternating current (AC) voltage signal to the transducer.

The transducer may be configured to convert electrical energy to an acoustic wave through interaction between the conductive microfluidic channel and the first substrate layer, and the acoustic wave may be a surface acoustic wave or a bulk acoustic wave.

The microfluidic device may be configured to control a conversion ratio of an acoustic wave to applied electrical energy; intensity of the acoustic wave, or a wavelength of the acoustic wave, by adjusting a concentration, a viscosity, or an injection amount of the conductive material.

The plurality of transducers may include at least one transducer pair of transducers that are provided to face each other. The transducer pair may be provided so that acoustic waves intersect based on a control target channel.

According to another aspect of at least one example embodiment, there is provided a method of manufacturing a microfluidic device, the method including preparing a first substrate; forming a trench in a form of a microfluidic channel on a transducer region and a control target channel region of a second substrate; providing a surface on which the trench of the second substrate is formed on one surface of the first substrate; irreversibly bonding the first substrate and the second substrate; and forming a conductive microfluidic channel by filling a portion of or all of the microfluidic channel formed on the transducer region with a conductive material.

The forming of the trench in the form of the microfluidic channel may use a mask pattern-based photolithography or molding method.

The microfluidic device manufacturing method may further include performing plasma surface treatment on at least one surface of the first substrate, the second substrate, or both thereof, prior to providing the surface.

Effect

According to example embodiments, a microfluidic device may generate an acoustic wave through interaction between a piezoelectric element and a conductive microfluidic channel including a conductive material, without a need to provide an electrode on a transducer region.

According to example embodiments, a microfluidic device may variously design a form and alignment of a microfluidic channel and a shape and an area of a contact surface between a control target and an acoustic wave and may flexibly modify the acoustic wave to be suitable for the control target. Thus, the utilization efficiency of the microfluidic device may be enhanced.

According to example embodiments, a microfluidic device may use various types of experimental targets, such as cytosol and blood, without being subject to a property of a control target fluid, and may separate microparticles from the control target fluid conveniently and quickly without using an expensive device for controlling a flow speed.

According to example embodiment, a method of manufacturing a microfluidic device does not require a complex bonding process according to expensive equipment and additional chemical materials and a microelectrode pattern process essentially required during an existing process of implementing an acoustic wave based microfluidic device, and thus may simplify a process procedure and decrease manufacturing cost.

According to example embodiments, a method of manufacturing a microfluidic device may precisely apply a force of a surface acoustic wave at a precise single location and may manufacture an error-free and highly reliable microfluidic device.

According to example embodiments, a method of manufacturing a microfluidic device may manufacture a microfluidic device in a form of an elongated channel with a width of less than or equal to tens of micro and a length of a centimeter to control tens to hundreds of nano sized particles, and may reduce an error during a bonding process regardless of a size and a shape.

BEST MODE

Hereinafter, example embodiments will be described. In the description of embodiments, detailed description of well-known related structures or functions will be omitted when it is deemed that such description will cause ambiguous interpretation of the present disclosure. Also, terms used herein are used to appropriately represent example embodiments and thus, may vary based on a user, an intent of an operator or a custom to which the present disclosure pertains. The terms used herein need to be defined based on the overall content of the present specification.

At least one example embodiment relates to a microfluidic device. The microfluidic device may generate an acoustic wave using a transducer including a conductive microfluidic channel, may control a control target using the generated acoustic wave, and may easily adjust the acoustic wave depending on the control target and may be designed into various types of devices depending on an application field. Also, the microfluidic device may be applied to control micro-sized or nanosized particles.

Figure 1A:
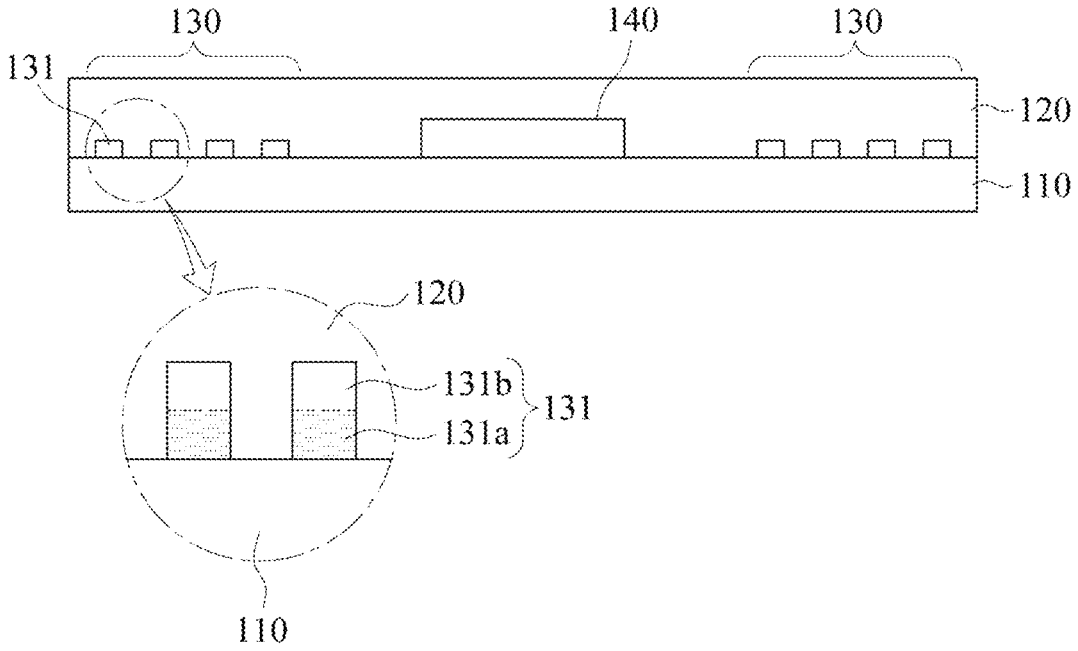
FIG. 1A is a cross-sectional view of a microfluidic device according to at least one example embodiment.

FIG. 1A is a cross-sectional view of a microfluidic device according to at least one example embodiment. Referring to FIG. 1A, the microfluidic device may include a first substrate layer 110; a second substrate layer 120; a transducer 130; and a control target channel 140.

According to an example embodiment, the first substrate layer 110 is induced to generate an acoustic wave through interaction with the transducer 130 on a surface on which the first substrate layer 110 contacts with the transducer 130 in response to applying of a voltage and may be a flexible substrate that includes a piezoelectric coating layer or a piezoelectric substrate.

For example, the piezoelectric substrate or the piezoelectric coating layer may use any piezoelectric materials applicable to the microfluidic device. The piezoelectric substrate or the piezoelectric coating layer may include, for example, at least one of $\alpha$-$AlPO_4$(berinite), $\alpha$-$SiO_2$ (quartz), $LiTaO_3$, $LiNbO_3$, $SrxBayNb_2O_8$ (in which X and Y denote rational numbers), $Pb_5$—$Ge_3O_{11}$, $Tb_2(MoO_4)_3$, $Li_2B_4O_7$, $Bi_{12}SiO_20$, $Bi_{12}GeO_2$, lead zirconate titanate (LZT), barium titanate (BTO), bismuth ferric oxide (BFO), platinum oxide (PTO), ZnO, CdS, GaN, AlN, VDF, ZnMgO, InN, GeTe, $ZnSnO_3$, $KNbO_3$, $NaNBO_3$, P(VDF-TrFe), P(VDFTeFE), TGS, PZT-PVDF, PZT-silicone rubber, PZT-epoxy, PZT-foam polymer, PZT-foamed urethane, and polyvinylidene difluoride (PVDF). However, it is provided as an example only.

For example, the flexible substrate may use any flexible substrate applicable to the microfluidic device and may be a polymer substrate, for example, including at least one of polyethylene terephthalate, polycarbonate, polyethylene naphthalene, polyimide, polyethersulfone, polyurethane, polycycloolefin, and polyvinyl alcohol. However, it is provided as an example only.

According to an example embodiment, the transducer 130 is configured to generate a surface acoustic wave through interaction with the first substrate layer 110 and may be formed on the first substrate layer 110 and be included in the second substrate layer 120. The transducer 130 includes a conductive microfluidic channel 131 and generates a surface acoustic wave using the conductive microfluidic channel 131. Therefore, there is no need to form an additional electrode to generate an acoustic wave.

Figure 1B:
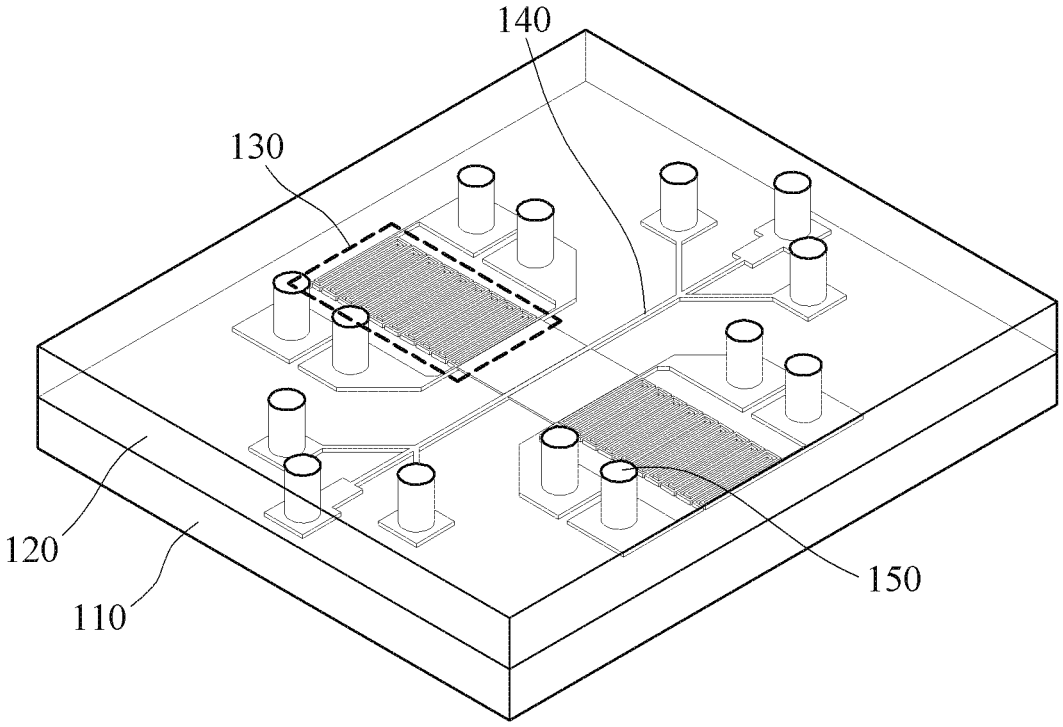
FIG. 1B illustrates an example of a microfluidic device according to at least one example embodiment.

For example, the plurality of transducers 130 may include at least one transducer pair of transducers that are provided to face each other. For example, a number of transducer pairs and an arrangement thereof may be adjusted based on a control target, that is, a target to be controlled. Desirably, the transducer pair may be provided so that acoustic waves may interest based on the control target channel 140 to easily control particles by acoustic waves. For example, FIG. 1B illustrates an example of a microfluidic device according to at least one example embodiment. Referring to FIG. 1B, a single transducer pair is provided so that the transducers 130 may face each other based on the control target channel 140. As another example, referring to FIG. 5, two transducer pairs are provided to face each other based on the control target channel 140.

As an example, the conductive microfluidic channel 131 may include an electrically conducting channel layer 131*a*; and an inlet (not shown) for injecting a conductive material. The conductive microfluidic channel 131 may convert electrical energy applied through interaction between the electrically conducting channel layer 131*a* and the first substrate layer 110 to a surface acoustic wave. That is, the electrically conducting channel layer 131*a* may transmit the electrical energy to the first substrate layer 110 in contact therewith in the conductive microfluidic channel 131. The first substrate layer 110 may generate a surface acoustic wave through a direct piezoelectric effect of producing vibration energy by the transmitted electrical energy and a control target may be controlled using a pressure node and an anti-pressure node.

For example, referring to FIG. 1B, the transducer pair may be provided so that the transducers 130 may face each other on the microfluidic device. A standing surface acoustic wave generated using overlapping and offset of surface acoustic waves intersecting in a direction in which the transducers 130 included in the transducer pair face each other may generate an anti-pressure node at which maximum vibration energy occurs due to overlapping and a pressure node at which minimum vibration energy occurs due to offset, on a region between the facing transducers. A mode control target, that is, microparticles may move toward the pressure node or the anti-pressure node through a force by the standing surface acoustic wave. Here, an elastic force Fr may have the relationship as represented by Equation 1.

$$F_r = -(\pi p_0^2 V_c \beta_w / 2\lambda) \cdot \Phi(\beta, \rho) \cdot \sin(2kx) \quad \text{[Equation 1]}$$

$$\text{Here, } \Phi(\beta, \rho) = \frac{5\rho_c - 2\rho_w}{2\rho_c + \rho_w} - \frac{\beta_c}{\beta_w} \text{ and,}$$

$$p_0 = \sqrt{\frac{PZ}{A}}.$$

In Equation 1, $p_0$, $\lambda$, and $V_c$ denote elastic pressure, wavelength, and volume of target particles, respectively, $\rho_c$, $\rho w$, $\beta c$, and $\beta w$ denote a density of target particles, a density of medium, compressibility of target particles, and compressibility of the medium, respectively, and P, Z, and A denote input power, impedance of an electrode, and an area of a region affected by the surface acoustic wave, respectively.

$\Phi$ denotes a value used to determine an equilibrium point of microparticles. If $\Phi>0$, the microparticles may move toward the pressure node. If $\Phi<0$, the microparticles may move toward the anti-pressure node. It can be known from the above equation that the elastic force of microparticles is affected by the volume and the compressibility of microparticles, that is, deformability.

Figure 1C:
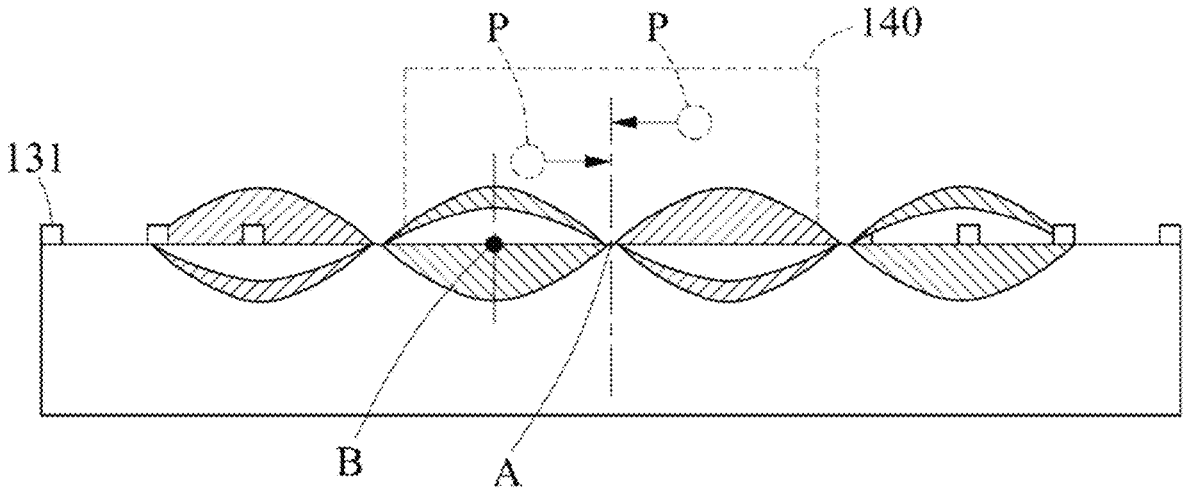
FIG. 1C illustrates an example of a standing surface acoustic wave by a microfluidic device according to at least one example embodiment.

In detail, the standing surface acoustic wave is described with reference to FIG. 1C. FIG. 1C illustrates an example of a standing surface acoustic wave by a microfluidic device according to at least one example embodiment. In FIG. 1C, in the standing surface acoustic wave, a point corresponding to a displacement of 0 is a pressure node A and a point corresponding to a maximum displacement is an anti-pressure node B. At the pressure node A, vibration energy is minimized due to energy offset. At the anti-pressure node B, the vibration energy is maximized due to energy overlapping. The fluid in the control target channel 140 surrounded by the second substrate 120 includes particles P to be controlled. The particle P to be controlled receives a force toward the pressure node A by the standing surface acoustic wave. That is, a condition of $\Phi>0$ is met in Equation 1. Whether the particle P to be controlled moves toward the pressure node A or the anti-pressure node B by the standing surface acoustic wave may be determined based on elastic properties between the particle to be controlled and the surface acoustic wave.

Figure 1D:
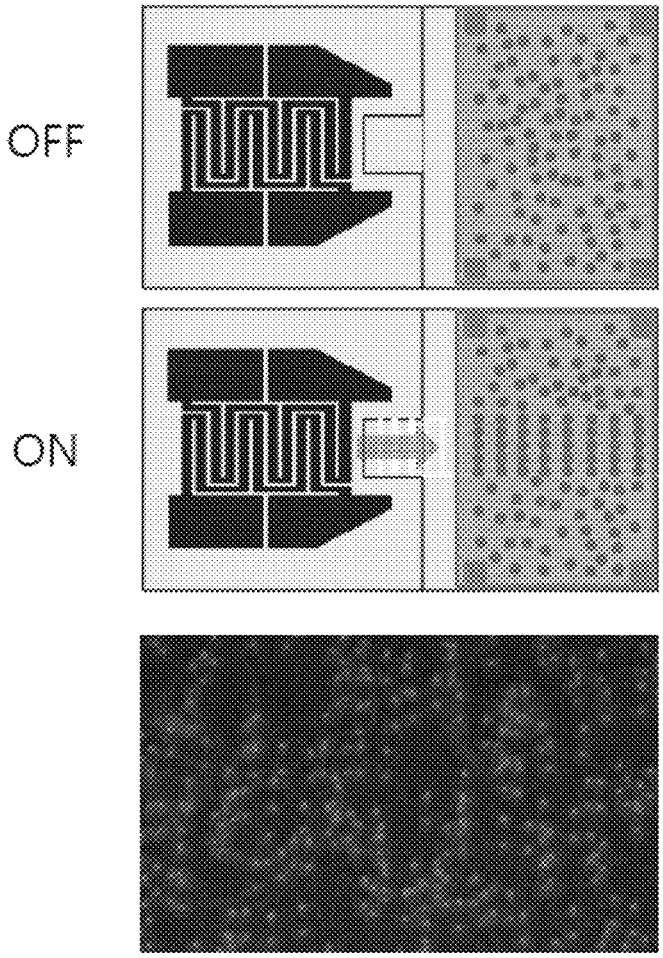
FIG. 1D illustrates an example of controlling particles using a microfluidic device according to at least one example embodiment.

For example, FIG. 1D illustrates an example of controlling particles using a microfluidic device according to at least one example embodiment. When an AC voltage having a frequency corresponding to the conductive microfluidic channel 131 is applied (ON state, operational frequency of 31.81 MHz, voltage condition of 14 V), the surface acoustic wave is generated by electrical energy transmitted on the first substrate layer 110. A control target, that is, microparticles (1% Hct RBS suspension in PBS) that are irregularly floating by a pressure node and an anti-pressure node may be controlled to constitute a linear pattern at desired intervals.

For example, the electrically conducting channel layer 131*a* may include a conductive material that occupies a portion of or all of the conductive microfluidic channel 131 and may be used as an electrode to generate an acoustic wave.

For example, referring to 1A, the electrically conducting channel layer 131*a* may reach less than 100%; 90% or less; 80% or less; or 50 to 70% of a height of the conductive microfluidic channel 131. A space 131*b* may be formed between the electrically conducting channel layer 131*a* and an upper portion of the conductive microfluidic channel 131 to easily adjust intensity and wavelength of the acoustic wave.

For example, any type of materials capable of transmitting electricity may be used for the conductive material, and an appropriate material may be selected to adjust a control target and a desired wavelength and intensity of an acoustic wave. Desirably, the conductive material may include at least one of metal particles; inorganic and polymer electrolytes; and a transition metal-based material; and a conductive carbon material. For example, the metal particles may be Ag, Pt, Au, Mg, Al, Zn, Fe, Cu, Ni, Pd, and the like. For example, the inorganic electrolyte may be sulfuric acid ($H_2SO_4$), hydrochloric acid (HCl), sodium hydroxide (NaOH), potassium hydroxide (KOH), sodium nitrate, sodium chloride (NaCl), lithium chloride (LiCl), potassium chloride (KCl), potassium nitrate ($KNO_3$), sodium nitrate ($NaNO_3$), sodium sulfate ($Na_2SO_4$), sodium sulfite ($Na_2SO_3$), sodium thiosulfate ($Na_2S_2O_3$), sodium pyrophosphate ($Na_4P_2O_7$), phosphoric acid ($H_3PO_4$), and the like. For example, the polymer electrolyte may be PDDA (poly(diallyldimethylammonium chloride)), PEI (poly(ethylene imine)), PAA (poly(amic acid)), PSS (poly(styrene sulfonate)), PAA (poly(allyl amine)), CS (Chitosan), PNIPAM (poly(N-isopropyl acrylamide)), PVS (poly(vinyl sulfate)), PAH (poly(allylamine), PMA (poly(methacrylic acid), and the like. For example, the transition metal-based material may be conductive oxide including at least one of indium (In), tin (Sn), zinc (Zn), gallium (Ga), cerium (Ce), cadmium (Cd), magnesium (Mg), beryllium (Be), silver (Ag), molybdenum (Mo), vanadium (V), cupper (Cu), iridium (Ir), rhodium (Rh), ruthenium (Ru), tungsten (W), cobalt (Co), nickel (Ni), manganese (Mn), aluminum (Al), and lanthanum (La), and alloy thereof. Desirably, the alloy may be eutectic alloy that is readily injectable into the conductive microfluidic channel 131 and is present in a liquid form at a room temperature, which is suitable for controlling an acoustic wave with appropriate viscosity. For example, the conductive carbon material may be carbon nano tube, carbon power, graphene, graphite, and the like.

For example, the electrically conducting channel layer 131*a* may include a liquid conductive material; or a solution that contains a conductive material, suspension, or paste.

For example, the liquid conductive material may be a conductive material that is present in a liquid form at a room temperature, and may be a eutectic alloy, for example, EGa—In.

For example, the solution that contains the conductive material is in a state in which the aforementioned conductive material is dissolved in a solvent and may be a solution that contains, for example, the electrolyte. For example, the solvent may be water, methanol, ethanol, isopropanol, 1-methoxypropanol, butanol, ethylhexyl alcohol, terpineol, ethylene glycol, glycerin, ethyl acetate, butyl acetate, methoxypropylacetate, carbitol acetate, ethyl carbitol acetate, methyl cellosolve, butyl cellosolve, diethyl ether, tetrahydrofuran, dioxane, methyl ethyl ketone, acetone, dimethyl formamide, 1-methyl-2-pyrrolidone, dimethylsulfoxide, hexane, heptane, paraffin oil, mineral spirit, toluene, xylene, chloroform, acetonitrile, and the like. However, it is provided as an example only.

For example, the suspension may be in a state in which the conductive material is dispersed in a solvent and may include, for example, the transition metal-based material and/or carbon material. The solvent is described above.

For example, the paste may be an ink composition including the conductive material; solvent; and binder. The solvent and the binder may be appropriately selected based on the conductive material, a control target, desired wavelength and intensity of an acoustic wave, and the like. Any type of binders applicable to the microfluidic device may be used.

Desirably, a volatile binder may be used for the binder. In detail, the binder may be acrylic, cellulose, polyester, polyether, vinyl, urethane, urea, alkyd, silicone, fluorine, olefin, rosin, epoxy, unsaturated polyester, phenol, melamine resin, and a derivative thereof. However, it is provided as an example only.

For example, the liquid conductive material; or the solution that contains the conductive material, suspension, or paste may be formed at appropriate viscosity to control intensity and a wavelength of an acoustic wave based on a control target.

For example, the solution that contains the conductive material and the suspension may be formed at appropriate concentration to control the intensity and the wavelength of the acoustic wave based on the control target.

For example, the conductive material in the conductive microfluidic channel 131 may be reusable.

According to an example embodiment, the conductive microfluidic channel 131 may be formed as a channel optimized to generate an acoustic wave based on a control target by controlling a design parameter, such as an alignment, a width, and a height of a channel.

According to an example embodiment, the control target channel 140 may be formed on the first substrate layer 110 and be included in the second substrate layer 120. The control target channel 140 may include a microfluidic channel through which a control target fluid, including particles to be controlled, flows. The control target channel 140 may further include an inlet and an outlet (not shown) configured to inject and discharge a control target.

For example, the microfluidic channel of the control target channel 140 may be optimized to control a flow of the control target and the control target by acoustic wave by adjusting a design parameter, such as an alignment, a width, and a height of a channel. The microfluidic channel of the control target channel 140 may have a shape and a size different from or identical to those of the conductive microfluidic channel 131.

According to an example embodiment, the second substrate layer 120 may be formed on the first substrate layer 110, and may include the transducer 130 and/or the control target channel 140.

For example, the second substrate layer 120 may be a polymer substrate that includes a photocurable polymer, a thermosetting polymer, or both thereof.

For example, the polymer substrate may include at least one of polyethylene terephthalate, polycarbonate, polyimide, polyethylene naphthalate, polyether sulfone, polyacrylate, polyurethane, polycycloolefin polyvinyl alcohol, poly (dimethylsiloxane) (PDMS), polyurethane acrylate (PUA), and perfluoropolyether (PFPE). However, it is provided as an example only.

For example, the polymer substrate may be a transparent polymer substrate. A location of a conductive material in the microfluidic channel and a process of filling the conductive material using the transparent polymer substrate may be visually verified. Also, a control phenomenon of the control target by acoustic wave and the flow of the control target may be visually verified.

According to an example embodiment, control of particles by the acoustic wave may perform functionality, such as focusing, selective separation, concentration, and mixing of particles, and may be applied to, for example, sample pretreatment, separation of microparticles associated with chemistry, biotechnology, and medicine, concentration, such as linear concentration of nanoparticles, alignment according to an orthogonal mode, a patterning experiment analysis such as linear patterning of particles, diagnosis, and the like, based on the microfluidic device.

Alternatively, control of particles by the acoustic wave may be applied to evaluate the concentration of microparticles from a correlation between the intensity of fluorescence and the concentration of an injected sample.

According to an example embodiment, the control target may be particles in a fluid or the fluid itself. For example, the control target may be selected without limitation if the microfluidic device is applicable in various fields, such as chemistry, biotechnology, and medicine. For example, the control target may be a cell fluid, blood, a virus, bacterium, cell, and a low-concentration disease cell. For example, the particle may have a nano-size and/or micro-size. For example, the fluid may have various concentration and various viscosities. For example, the fluid may be a low viscosity liquid or a high viscosity liquid.

According to an example embodiment, in the microfluidic device, a form, a size, and an alignment of each of the conductive microfluidic channel 131 and the control target channel 140 may be appropriately modified and changed based on an application field of the microfluidic device, a control target, and a method of processing the control target. For example, referring to FIG. 5, unless the fluid to be controlled flows, the control target channel 140 may form a control target chamber 540 and may control the control target in the control target chamber 540. Alternatively, the control target channel 140 may control the control target by dropping a control target liquid in a controllable region by surface acoustic wave that is generated by the transducer, for example, at least a portion on the second substrate 120, such as an empty region between transducer pairs.

According to an example embodiment, an output form and a type of the acoustic wave may be modifiable based on the control target to improve quantitative and qualitative processing performance. For example, the acoustic wave may be a standing surface acoustic wave (SSAW), a surface acoustic wave such as a stop surface acoustic wave, and a bulk acoustic wave.

According to an example embodiment, without departing from the purpose of the present disclosure, the microfluidic device may further include a microfluidic device configuration applied in the technical field of the present disclosure for voltage appliance, emission, and injection of a sample including particles to be controlled.

Figure 1E:
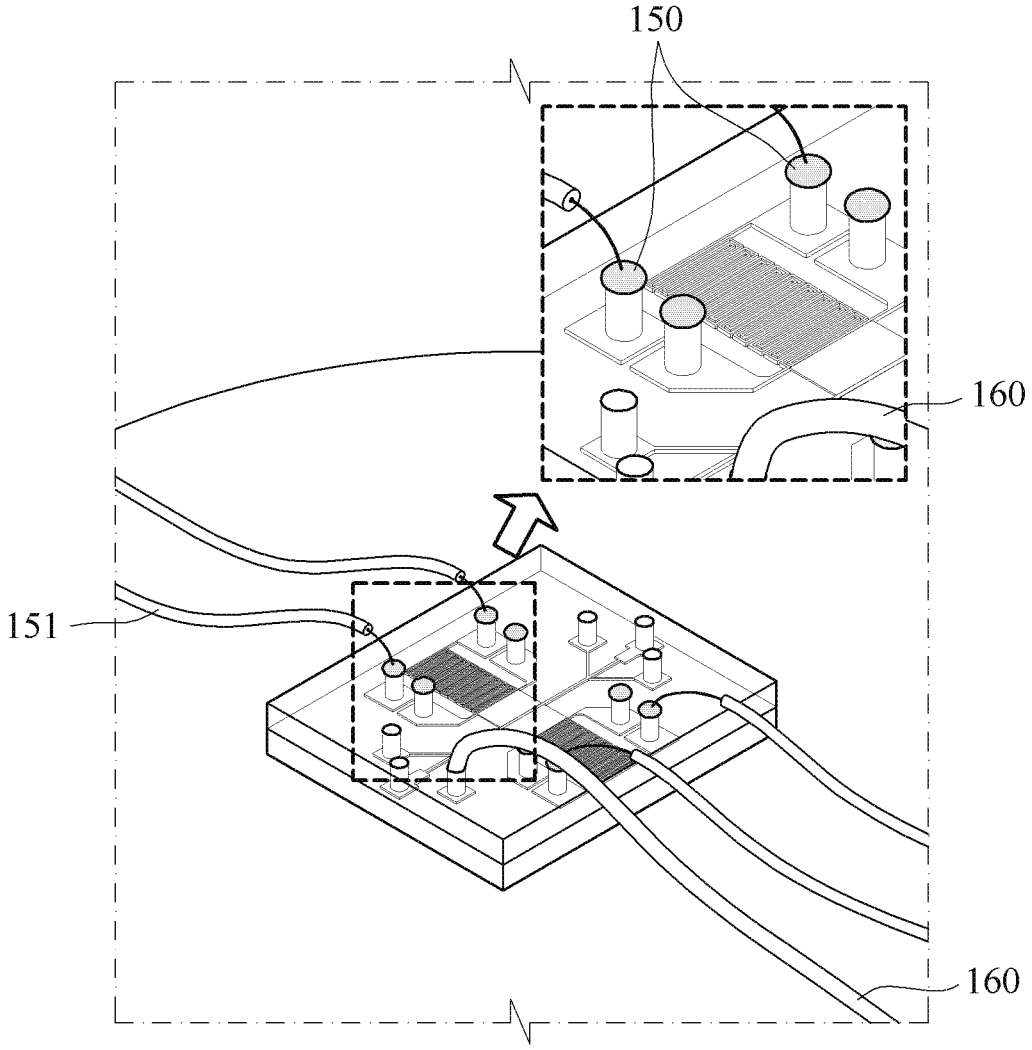
FIG. 1E illustrates another example of a microfluidic device according to at least one example embodiment.

FIG. 1E illustrates an example of a microfluidic device according to at least one example embodiment. Referring to FIG. 1E, the microfluid device may include a voltage input terminal 150 configured to apply an AC voltage signal to the conductive microfluidic channel 131; a tube 160 configured to inject the control target, and the like.

For example, the voltage input terminal 150 may induce generation of an acoustic wave by applying AC voltage of an operating frequency (or wavelength) corresponding to the conductive material of the conductive microfluidic channel 131.

For example, the voltage input terminal 150 is connected to an AC power source through an electrical conduction line 151 and an AC voltage signal is applied from the AC power source to the conductive microfluidic channel 131 through the electric conduction line 151 and the voltage input terminal 150. Also, the voltage input terminal 150 is divided into an anode and a cathode and thereby connected to the AC power source. The respective polarities are connected to a signal generation control device and an anode and a cathode of an amplifier that amplifies the signal. Each of the devices may be connected with a power supplier that controls an input voltage.

The microfluidic device illustrated in the attaching drawings is provided as an example only and the scope of the microfluidic device is not limited by the drawings.

The example embodiments relate to a method of manufacturing the microfluidic device. The microfluidic device manufacturing method may design and manufacture a transducer region for generating and controlling an acoustic wave and a control target channel region in which a control target flows simultaneously and/or on the same substrate. Accordingly, it is possible to perform accurate alignment and bonding. Further, there is no need for an electrode pattern process and a bonding process may be performed without using expensive equipment and reagent, such as a high-power microscope and ethanol. Accordingly, a manufacturing process of the microfluidic device may be simplified and manufacturing cost may be reduced.

Figure 2A:
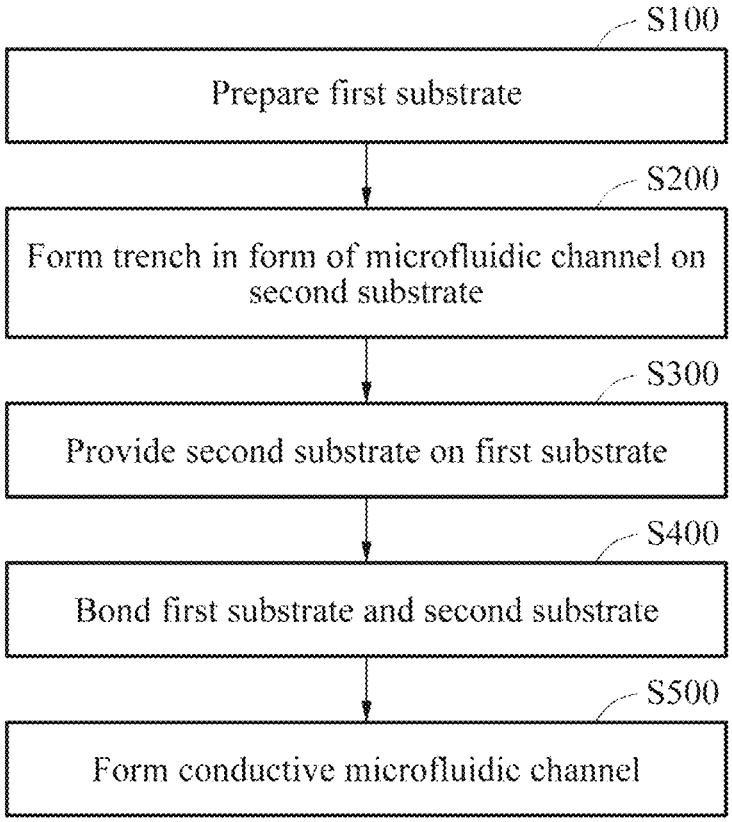
FIG. 2A is a flowchart illustrating an example of a method of manufacturing a microfluidic device according to at least one example embodiment.

FIG. 2A is a flowchart illustrating an example of a method of manufacturing a microfluidic device according to at least one example embodiment. Referring to FIG. 2A, the microfluidic device manufacturing method may include operation S100 of preparing a first substrate; operation S200 of forming a trench in a form of a microfluidic channel on a second substrate; operation S300 of providing the second substrate on the first substrate; operation S400 of bonding the first substrate and the second substrate; and operation S500 of forming a conductive microfluidic channel.

Figure 2B:
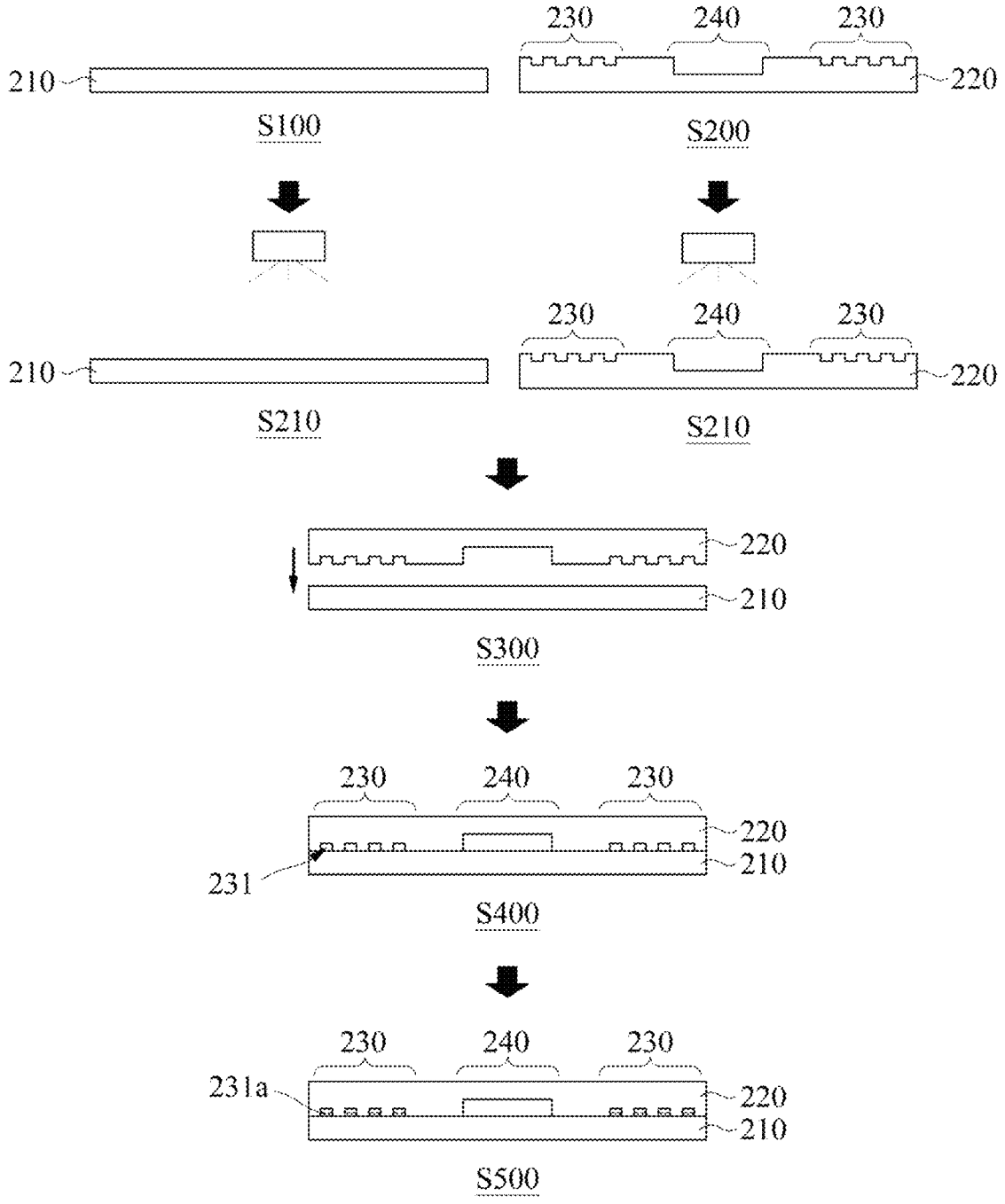
FIG. 2B illustrates an example of a process of manufacturing a microfluidic device according to at least one example embodiment.

FIG. 2B illustrates an example of a process of manufacturing a microfluidic device according to at least one example embodiment. For example, in operation S100 of preparing a first substrate, a first substrate 210 for generating an acoustic wave through interaction with a conductive microfluidic channel is prepared in the microfluidic device. As described above, the first substrate 210 may be a flexible substrate that includes a piezoelectric coating layer or a piezoelectric substrate.

In operation S200 of forming a trench in a form of a microfluidic channel, a trench in a form of the microfluidic channel may be formed on each region of the microfluidic device on the second substrate 220. For example, the region may be a transducer region 230, a control target channel region 240, and the like. The trenches corresponding to the respective regions may be simultaneously or respectively formed. Desirably, the trenches may be simultaneously formed and thereby induce locations of the transducer region 230 and the control target channel region 240 to be aligned precisely as designed. An error occurring during a bonding process may be removed. That is, when a transducer and a control target channel are manufactured together, a parallelism and an angle may be set through a single process procedure.

For example, operation S200 of forming a trench in a form of a microfluidic channel may use a mask pattern-based photolithography or molding method. For example, the transducer region 230 and the control target channel region 240 may be cut-out processed through a photolithography process using the same mask pattern or two or more mask patterns and trenches may be formed thereon. The trenches may be formed on the transducer region 230 and the control target channel region 240 through a single process using the same mask pattern. Also, each of the transducer region 230 and the control target channel region 240 may be formed using the same mask pattern.

For example, the molding method may be a cast molding method of forming a trench by heating a polymer material for second substrate formation, by pouring the heated polymer material into a patterned prototype through a semiconductor process, such as a photolithography process, and by baking the same in an oven and casting and molding the same.

For example, operation S200 of forming a trench in a form of a microfluidic channel may appropriately apply a photocurable polymer and a thermosetting polymer based on a trench forming method. For example, the molding method may use a thermosetting polymer such as PDMS.

For example, in operation S300 of providing the second substrate on the first substrate, a surface on which the trench of the second substrate 220 is formed is provided on one surface of the first substrate 210. After operation S300, at least a portion (conductive material inlet, sample inlet and outlet, etc., are open) of the trench may be covered with the first substrate 210, and a bottom surface of the trench by the first substrate 210 forms a contact surface between the conductive material and the first substrate 210. Accordingly, when voltage is applied, an acoustic wave may be generated by inducing interaction therebetween.

For example, operation S210 of performing plasma surface treatment may be further performed before operation S300 of providing the second substrate on the first substrate. In operation S210, plasma surface treatment is performed on at least one surface of the first substrate 210, the second substrate 220, or both thereof. The plasma surface treatment may be performed on the surface on which the first substrate 210 and the second substrate 220 are bonded. Through such surface treatment, irreversible bonding may be easily induced. For example, at least one plasma of oxygen ($O_2$), nitrogen ($N_2$), hydrogen ($H_2$), and argon (Ar) may be used.

For example, in operation S400 of bonding the first substrate and the second substrate, the first substrate 210 and the second substrate 220 are irreversibly bonded. For example, after bonding, the first substrate 210 is used as a lower layer and the second substrate 220 is used as an upper layer. Once at least a portion of the trench is covered with the first substrate 210, the microfluidic channel may be formed on each region.

Figure 2C:
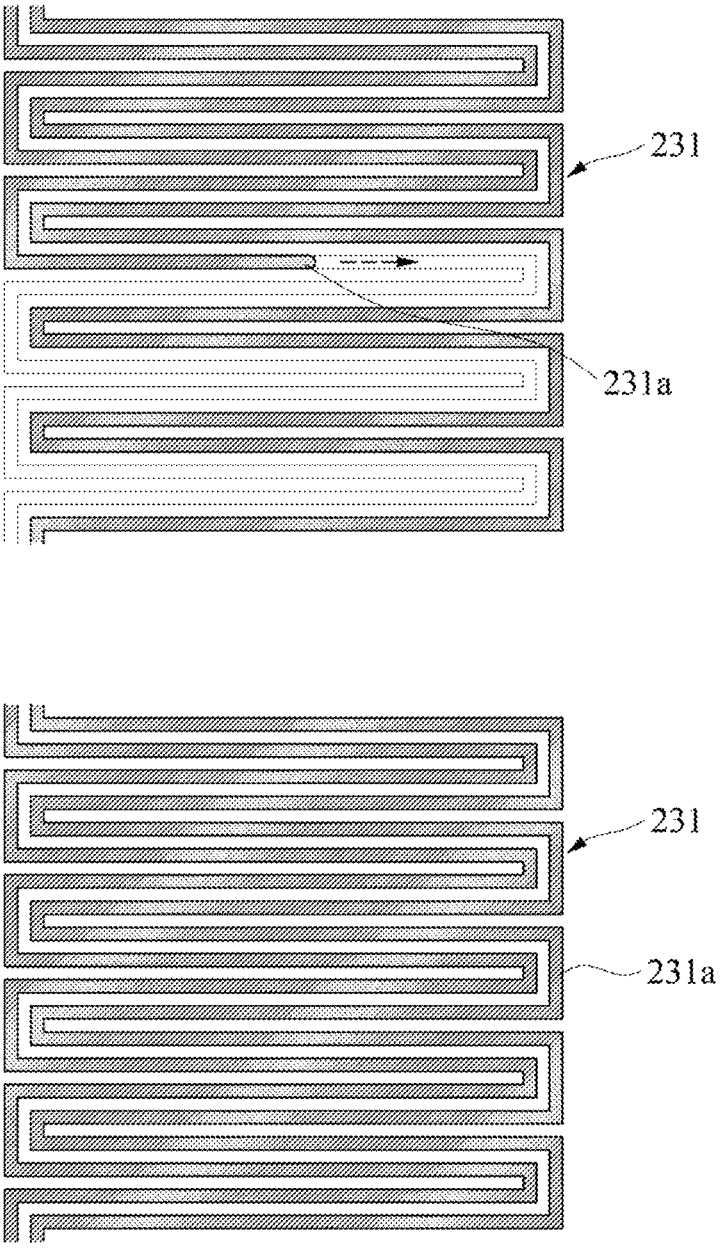
FIG. 2C illustrates an example of forming a conductive microfluidic channel according to at least one example embodiment.

For example, in operation S500 of forming a conductive microfluidic channel, a conductive microfluidic channel 231 on which a conductive material layer 231*a* is formed is formed by injecting the conductive material into the microfluidic channel 231 of the transducer region. For example, FIG. 2C illustrates an example of an operation of forming a conductive microfluidic channel according to at least one example embodiment. Referring to FIG. 2C, the conductive material may fill in the microfluidic channel 231 in a direction indicated with an arrowhead by injecting the conductive material in the inlet of the microfluidic channel 231 using a tube or a syringe. The conductive material is described above.

The microfluidic device manufacturing method may include a manufacturing process for adding a microfluidic device configuration applied in the technical field, without departing from the scope of the present disclosure. However, it is not described in detail herein.

Although the example embodiments are described, the present disclosure is not limited thereto and various modifications and alterations may be made thereto without departing from the following claims, the detailed description, and the spirit of the present disclosure, disclosed in the attaching drawings.

Example 1

Linear Patterning Experiment Using Microfluidic Device

The microfluidic device of FIG. 1D was manufacturing by patterning a first substrate and a second substrate of polydimethylsiloxane (PDSM) using photolithography and by filling a conductive microfluidic channel using eutectic gallium-indium (EGa—In). A single pair of conductive microfluidic channels are provided based on a straight-typed control target channel. The linear patterning experiment was performed on a control target by applying a voltage to the microfluidic device. A result thereof is illustrated in FIG. 3.

Figure 3:
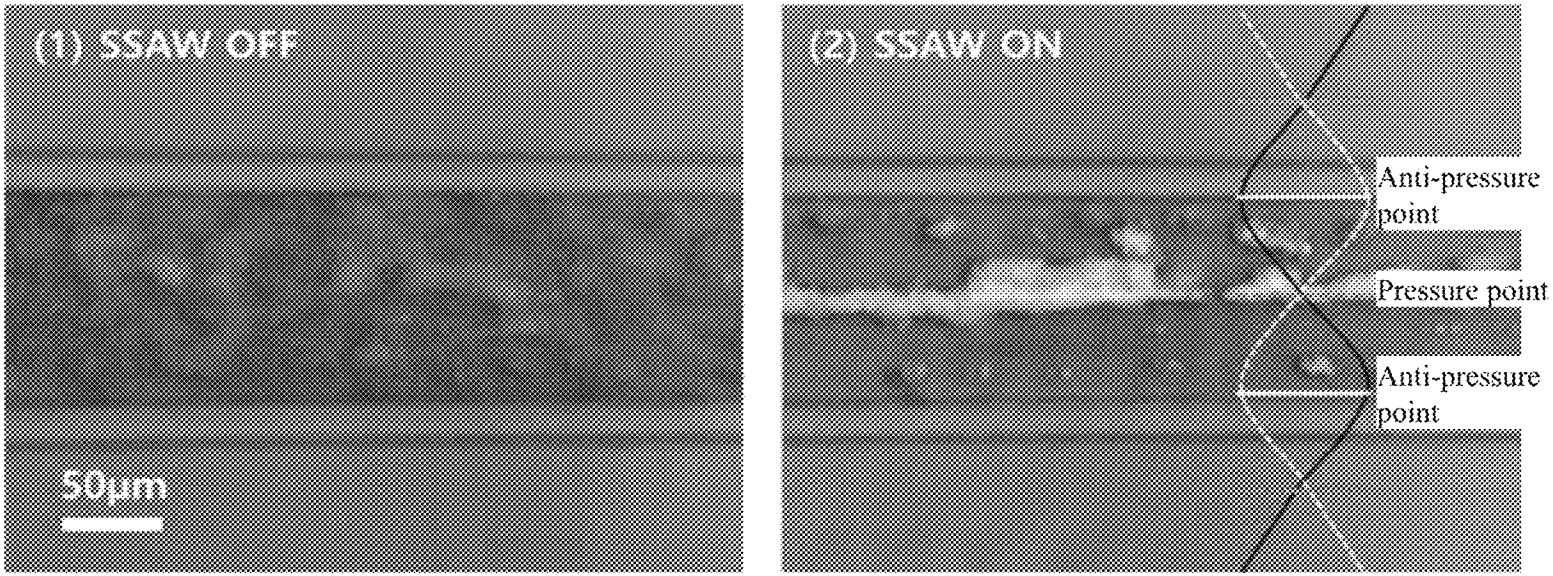
FIG. 3 illustrates an example of a linear patterning experiment result using a microfluidic device according to example 1 of at least one example embodiment.

FIG. 3 illustrates an SSAW OFF state. Referring to FIG. 3, fluorescent particles each with diameter of 10 μm are floating irregularly. Also, when the voltage is applied to the conductive microfluidic channel (SSAW ON state), an SSAW is generated. Accordingly, an anti-pressure node at which maximum vibration energy occurs due to overlapping and a pressure node at which minimum vibration energy occurs due to offset are generated. All of the particles are concentrated on the pressure node and are controlled to be in a linear pattern.

Example 2

Linear Concentration Experiment Using Microfluidic Device

The same microfluidic device as that of Example 1 was used and florescent particles each with diameter of 140 nm, that is, a semi-nano size (hundreds of nm size range) were concentrated. A result thereof is illustrated in FIG. 4.

Figure 4:
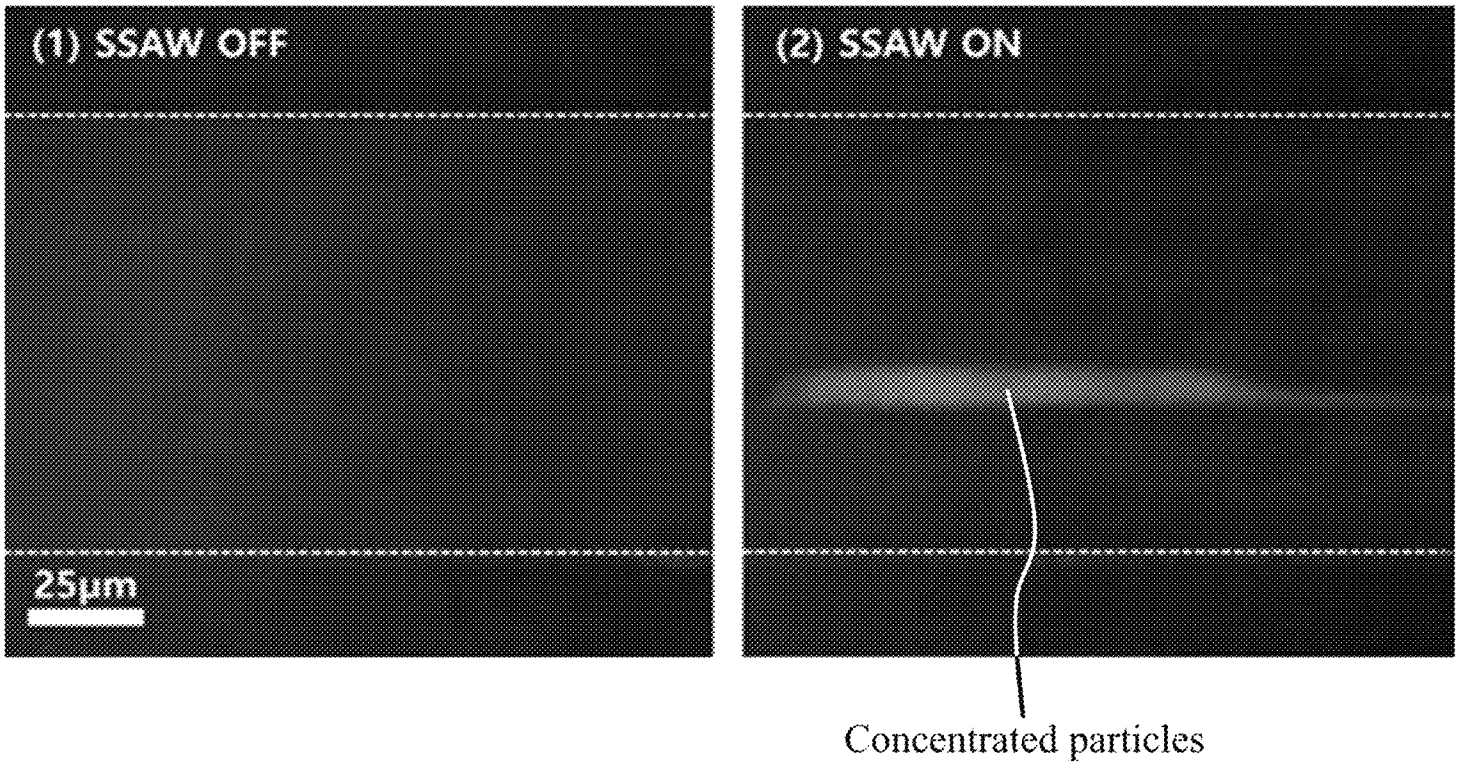
FIG. 4 illustrates an example of a linear concentration experiment result using a microfluidic device according to example 2 of at least one example embodiment.

Referring to FIG. 4, florescent particles each with diameter of 140 nm are randomly dispersed after small florescent particles were injected in the microfluidic device and particles are concentrated under condition of SSAW ON.

Example 3

Alignment of Microparticles Using Surface Acoustic Wave in Orthogonal Mode

Figure 5:
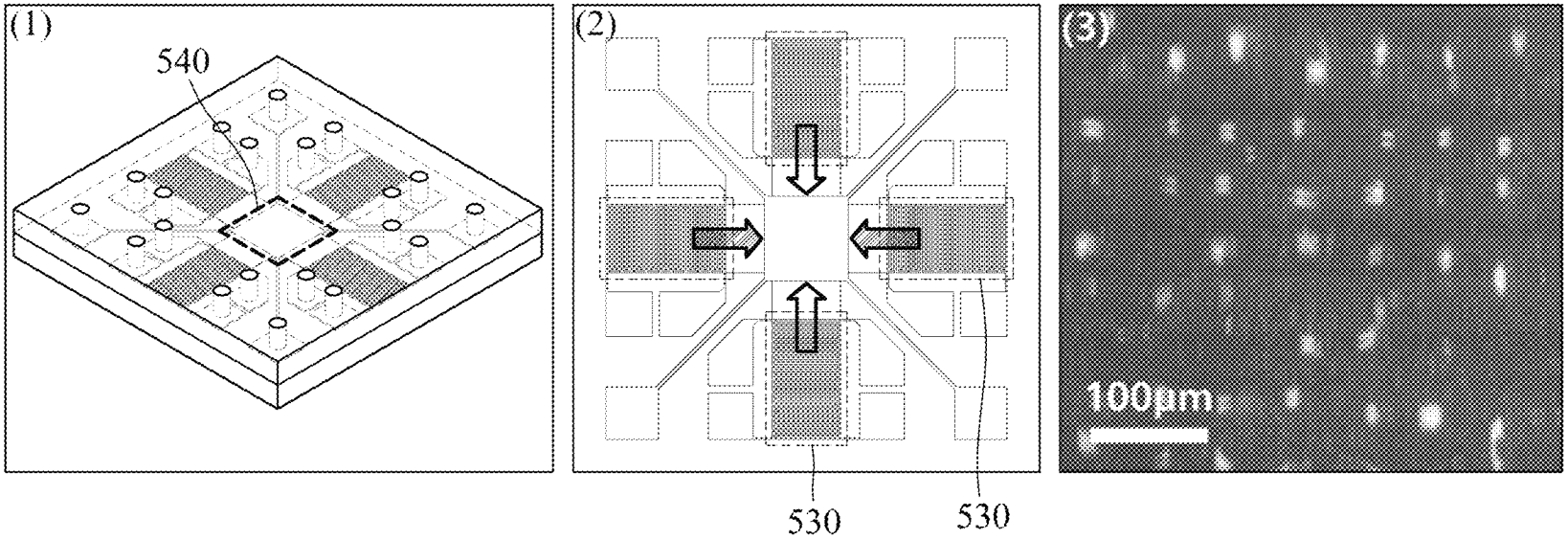
FIG. 5 illustrates an example of an experiment result of aligning microparticles of a surface acoustic wave in an orthogonal mode using a microfluidic device according to example 3 of at least one example embodiment.

The microfluidic device of FIG. 5 was used and a rectangular chamber 540 in which particles to be controlled are to be provided is present in the middle of the microfluidic device. Conductive microfluidic channels 530 are provided in four orientations of the chamber, respectively. The experiment of aligning microparticles using a surface acoustic wave of an orthogonal mode was performed and a result thereof is illustrated in FIG. 5. Referring to FIG. 5, indicators coming from the four direction into the rectangular chamber 540 present in the middle indicate surface acoustic waves, and the surface acoustic waves are orthogonal to each other, which lead into the rectangular chamber 540 for controlling microparticles. When AC voltage is applied to the conductive microfluidic channels 530 present in a direction in which two pairs of the conductive microfluidic channels 530 are orthogonally present with respect to the florescent particles that are irregularly distributed in the rectangular chamber 540, micro-florescent particles floating in the rectangular channel are aligned in a dot form.

The present disclosure may provide an acoustic wave-based microfluidic device including a transducer using a conductive microfluidic channel. The microfluidic device may be variously designed to control an acoustic wave based on a control target and a processing purpose and may be flexibly used in various fields. Also, the present disclosure may manufacture a highly reliable microfluidic device by inducing precise alignment and bonding between a transducer and a control target channel that are main configurations of the microfluidic device through a simple process.

What is claimed is:

1. A microfluidic device comprising:

a first substrate layer;

a second substrate layer formed on at least one surface of the first substrate layer;

a plurality of transducers formed on the first substrate layer and disposed within the second substrate layer; and a control target channel formed on the first substrate layer and included within the second substrate layer, wherein the transducer includes a conductive microfluidic channel, which includes an electrically conducting channel layer.

2. The microfluidic device of claim 1, wherein the electrically conducting channel layer includes a conductive material that occupies a portion of or all of the conductive microfluidic channel.

3. The microfluidic device of claim 2, wherein the electrically conducting channel layer includes a liquid conductive material; or a solution that contains a conductive material, suspension, or paste.

4. The microfluidic device of claim 2, wherein the conductive material includes at least one selected from the group consisting of metal particles of Ag, Pt, Au, Mg, Al, Zn, Fe, Cu, Ni, and Pd; inorganic and polymer electrolytes; a conductive oxide including at least one of indium (In), tin (Sn), zinc (Zn), gallium (Ga), cerium (Ce), cadmium (Cd), magnesium (Mg), beryllium (Be), silver (Ag), molybdenum (Mo), vanadium (V), cupper (Cu), iridium (Ir), rhodium (Rh), ruthenium (Ru), tungsten (W), cobalt (Co), nickel (Ni), manganese (Mn), aluminum (Al), and lanthanum (La), or alloy thereof; and carbon materials of carbon nano tube, carbon powder, graphene, and graphite.

5. The microfluidic device of claim 1, wherein the control target channel includes a microfluidic channel through which a control target fluid flows.

6. The microfluidic device of claim 1, wherein the first substrate is a flexible substrate that includes a piezoelectric coating layer or a piezoelectric substrate, and the piezoelectric substrate and the piezoelectric coating layer include at least one of selected from the group consisting of $\alpha$-$AlPO_4$ (berlnite), $\alpha$-$SiO_2$ (quartz), $LiTaO_3$, $LiNbO_3$, $SrxBayNb_2O_8$, $Pb_5$—$Ge_3O_{11}$, $Tb_2(MoO_4)_3$, $Li_2B_4O_7$, $Bi_{12}SiO_20$, $Bi_{12}GeO_2$, lead zirconate titanate (PZT), barium titanate (BTO), bismuth ferric oxide (BFO), platinum oxide (PTO), ZnO, CdS, GaN, AlN, VDF, ZnMgO, InN, GeTe, $ZnSnO_3$, $KNbO_3$, $NaNBO_3$, P(VDF-TrFe), P(VDFTeFE), TGS, PZT-PVDF, PZT-silicone rubber, PZT-epoxy, PZT-foam polymer, PZT-foamed urethane, and polyvinylidene difluoride (PVDF).

7. The microfluidic device of claim 1, wherein the second substrate layer includes photocurable polymer, thermosetting polymer, or both thereof, and the second substrate layer is a transparent polymer substrate.

8. The microfluidic device of claim 1, further comprising:

a voltage input terminal configured to input an alternating current (AC) voltage signal to the transducer.

9. The microfluidic device of claim 1, wherein the transducer is configured to convert electrical energy to an acoustic wave through interaction between the conductive microfluidic channel and the first substrate layer, and the acoustic wave is a surface acoustic wave or a bulk acoustic wave.

10. The microfluidic device of claim 1, wherein the microfluidic device is configured to control a conversion ratio of an acoustic wave to applied electrical energy; intensity of the acoustic wave, or a wavelength of the acoustic wave, by adjusting a concentration, a viscosity, or an injection amount of the conductive material.

11. The microfluidic device of claim 1, wherein the plurality of transducers includes at least one transducer pair of transducers that are provided to face each other, and the transducer pair is provided so that acoustic waves intersect based on a control target channel.

12. A method of manufacturing a microfluidic device, the method comprising:

preparing a first substrate;

forming a trench in a form of a microfluidic channel on a transducer region and a control target channel region of a second substrate;

providing a surface on which the trench of the second substrate is formed on one surface of the first substrate;

irreversibly bonding the first substrate and the second substrate; and forming a conductive microfluidic channel by filling a portion of or all of the microfluidic channel formed on the transducer region with a conductive material; and wherein the control target channel and the transducer region are formed on the first substrate and included within the second substrate.

13. The method of claim 12, wherein the forming of the trench in the form of the microfluidic channel uses a mask pattern-based photolithography or molding method.

14. The method of claim 12, further comprising:

performing plasma surface treatment on at least one surface of the first substrate, the second substrate, or both thereof, prior to providing the surface.

* * * * *